United States Patent [19]

McLean

[11] 3,994,063

[45] Nov. 30, 1976

[54] POWER OPERATED CAN OPENER WITH AUTOMATIC SHUT OFF MEANS

[75] Inventor: Robert E. McLean, Raytown, Mo.

[73] Assignee: Rival Manufacturing Company, Kansas City, Mo.

[22] Filed: Nov. 13, 1975

[21] Appl. No.: 631,722

[52] U.S. Cl. ..... 30/4 R
[51] Int. Cl.[2] ..... B67B 7/38
[58] Field of Search ..... 30/4 R, 8, 8.5, 9

[56] References Cited

UNITED STATES PATENTS

| | | | |
|---|---|---|---|
| 1,939,349 | 12/1933 | Holman | 30/4 R |
| 3,689,997 | 9/1972 | McLean | 30/4 R |
| 3,733,698 | 5/1973 | Yamamoto | 30/4 R |
| 3,787,967 | 1/1974 | McLean | 30/4 R |
| 3,798,764 | 3/1974 | Yamamoto | 30/4 R |
| 3,837,075 | 9/1974 | Yamamoto | 30/4 R |

*Primary Examiner*—Gary L. Smith
*Attorney, Agent, or Firm*—Lowe, Kokjer, Kircher, Wharton & Bowman

[57] ABSTRACT

An electrically powered can opener includes a can cutting element carried on a mounting plate which is pivoted to the can opener frame. An operating lever is connected to the mounting plate for limited pivotal movement beyond which the plate and lever pivot unitarily on the frame. A notched area on the hand lever becomes engaged against a catch member on the frame to retain the lever in place when it is brought into position to shear a can lid. The lever is held against a plunger switch which maintains the motor in its energized condition during shearing of the can lid. After the completion of the shearing when the operating thrust is no longer present, biasing forces acting on the lever disengage it from the catch member and release the plunger for automatic shut off of the motor.

10 Claims, 5 Drawing Figures

POWER OPERATED CAN OPENER WITH AUTOMATIC SHUT OFF MEANS

BACKGROUND AND SUMMARY OF THE INVENTION

This invention relates generally to can openers and more particularly to electric can openers of the type in which the motor is automatically shut off after the can lid has been completely sheared.

Can openers which employ an automatic shut off feature accomplish start up of the motor as the cutting element is brought into can shearing position and also shut off the motor automatically upon completion of the shearing of the can lid. Consequently, substantial energy savings are achieved, and the effort and inconvenience of the user are reduced.

It is a broad object of the present invention to provide, in an electric motor driven can opener of the type wherein the cutting element is brought into can cutting position by manipulation of a hand lever, simplified and improved means for accomplishing automatic shut off of the motor after the end has been completely sheared from a can.

Another object of the invention is to provide a can opener of the character described in which the automatic shut off means is simple, reliable in operation, and economical to produce.

A further object of the invention is to provide a can opener of the character described in which the cutting element is carried on a mounting plate and the hand lever is pivoted to the mounting plate for limited rotational movement relative thereto. This feature permits a small amount of play between the lever and mounting plate which facilitates the automatic shut off of the motor and assures that same will occur as intended.

Another object of the invention is to provide a uniquely constructed can opener of the character described which includes a catch member that positively maintains the hand lever in can shearing position at all times during shearing of the can, and means for automatically releasing the lever to accomplish automatic shut off of the motor after completion of the can shearing. Since the catch member securely holds the lever in can shearing position, the resilient can guide can be constructed with adequate strength to firmly maintain the rim or flange of the can on the teeth of the can feed wheel for proper driving traction without the possibility of automatic shut off occurring prior to the completion of the can shearing operation.

Yet another object of the invention is to provide a can opener of the character described which is constructed to permit pivotal attachment of the can piercing lever to the frame in any suitable manner, including various types of latching means which permit removal of the lever for cleaning and other purposes.

A still further object of the invention is to provide a can opener of the character described which includes braking means for preventing the hand lever from being moved sufficiently to release the can upon automatic shut off of the motor.

Other and further objects of the invention, together with the features of novelty appurtenant thereto, will appear in the course of the following description.

DETAILED DESCRIPTION OF THE INVENTION

In the accompanying drawing, which forms a part of the specification and is to be read in conjunction therewith, and in which like reference numerals are employed to indicate like parts in the various views.

Figure 4:
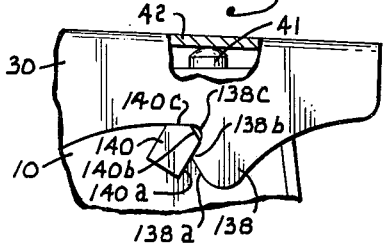
Figure 5:
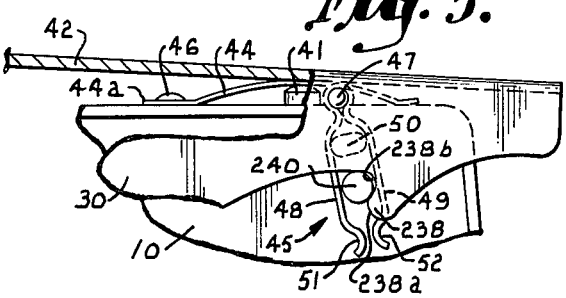

FIG. 4 is a fragmentary front elevational view illustrating the end of a hand lever and associated catch member constructed in accordance with a second embodiment of the invention and with a portion of the hand lever being broken away to illustrate the plunger switch; and FIG. 5 is a fragmentary front elevation view, similar to FIG. 4, illustrating the end of a hand lever and associated catch member constructed according to a third embodiment of the invention and with a portion of the hand lever being broken away to illustrate the plunger switch and the leaf spring.

Figure 1:
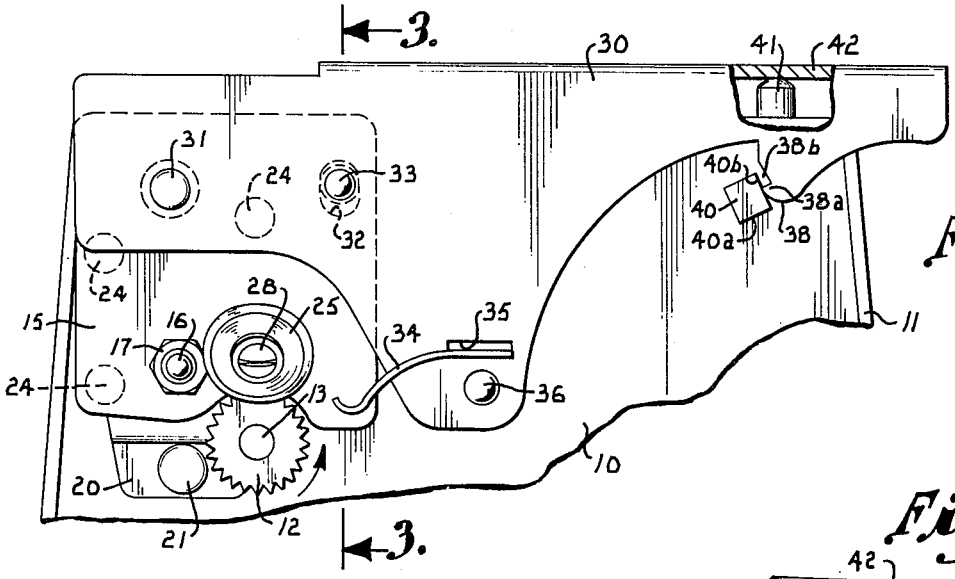
FIG. 1 is a front elevational view showing the top portion of a can opener constructed according to a first embodiment of the invention, with a portion of the hand lever broken away to illustrate the plunger switch, and the hand lever shown in its rest position.
Figure 2:
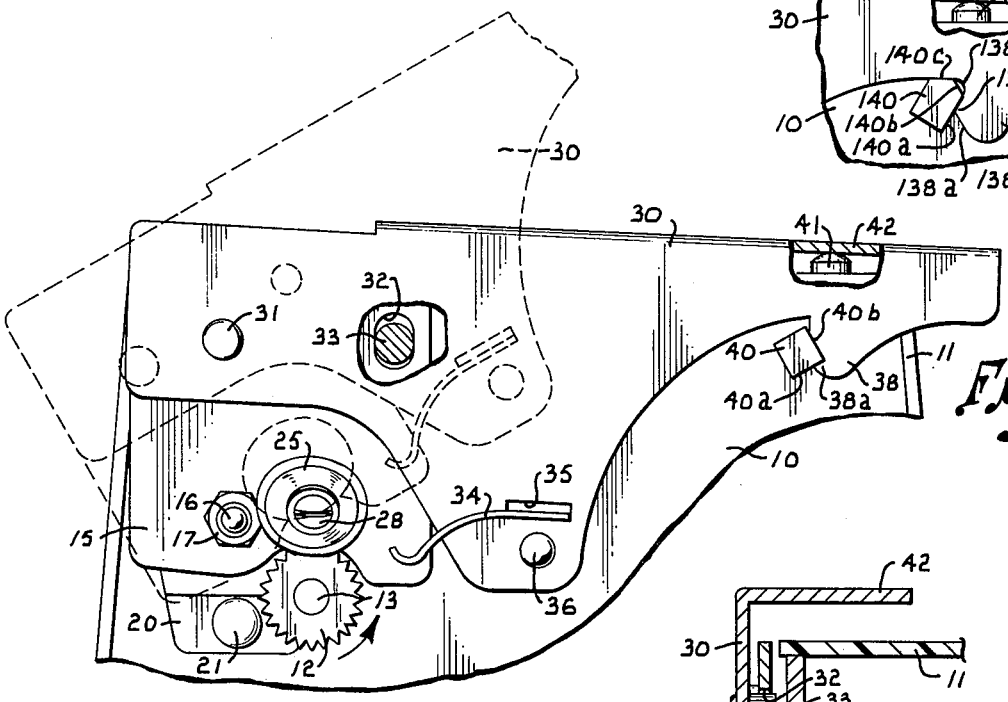
FIG. 2 is a front elevational view similar to FIG. 1, but showing the hand lever in its operating or can shearing position, the broken line view illustrating movement of the hand lever to permit insertion of the can.
Figure 3:
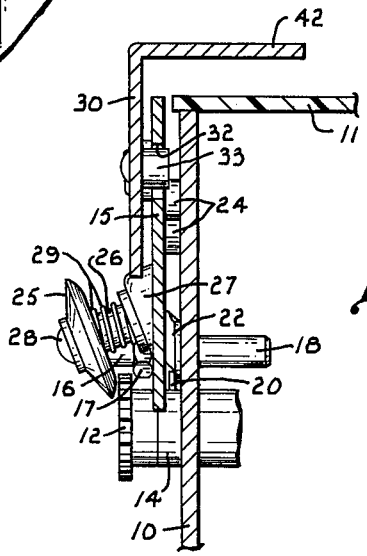
FIG. 3 is a sectional view taken generally along line 3—3 of FIG. 1 in the direction of the arrows.

Referring now to the drawing in detail, and initially to FIGS. 1–3, a can opener constructed according to a preferred embodiment of the invention includes an upright frame which is generally designated by reference numeral 10. Frame 10 cooperates with a box-like casing 11 to support and house the various operating components of the can opener.

A toothed can feed wheel 12 is mounted on a horizontal shaft 13 (forwardly of frame 10) for rotation in a boss 14 (FIG. 3) of frame 10. Shaft 13 is rotatively driven by a conventional electrical motor (not shown) usually through suitable gear reduction means (also not shown). A can guard (not shown) of the usual construction is mounted on frame 10 somewhat below feed wheel 12 in order to maintain the sidewall of an engaged can at the desired angle relative to the face of feed wheel 12.

A cutter mounting plate 15 is mounted for pivotal movement on the front surface of frame 10. A cylindrical can guide 16 is anchored in plate 15 and is secured in position by a jam nut 17. Can guide 16 projects forwardly from plate 15 to engage the rim of a can during operation of the can opener. A cylindrical pin 18 (FIG. 3) forms an axial extension of can guide 16 and extends rearwardly from plate 15 through an aperture in frame 10 to pivotally mount plate 15 on the can opener frame.

Plate 15 is removable from frame 10 and is preferably retained thereon by a latch structure such as that disclosed in U.S. Pat. No. 3,688,400 to which reference may be made for a more detailed understanding of the structure and its operation. As explained in the 3,688,400 patent, a latch plate 20 is secured to the forward surface of frame 10 by a rivet 21, so that it may normally engage an arcuately shaped latch 22 (FIG. 3) on pin 18 to retain plate 15 on the frame. However, when plate 15 is pivoted to an extreme counterclockwise position (FIG. 1), latch 22 is disengaged from latch plate 20 and pin 18 may be withdrawn from the frame aperture to remove plate 15 from the frame. It is to be understood that any other suitable latching means may be used to mount plate 15 on the frame, including that shown in U.S. Pat. No. 3,496,635.

Three bosses 24 have forward bearing surfaces projecting forwardly from frame 10 to bear against the rearward surface of plate 15. A cutter wheel 25 with the conventional sharp peripheral edge for severing a can lid is mounted on plate 15 at a location to be brought into can shearing position overlapping feed wheel 12 in response to pivotal movement of plate 15. Referring to FIG. 3, cutter wheel 25 is mounted on a stud 26 that is anchored in a compound angled boss 27 on the forward surface of plate 15. A screw 28 secures the cutter wheel on stud 26, while a compression spring 29 is fit around the stud to bias the cutter wheel outwardly in the usual manner.

A hand lever 30 is pivoted to the upper left portion of plate 15 by a shoulder rivet 31. The upper right portion of plate 15 is provided with an elliptical opening 32 which has its major axis oriented vertically. A cylindrical shoulder rivet 33 is anchored in lever 30 and projects rearwardly therefrom. Rivet 33 is received in opening 32, same being sized to present considerable clearance between the rivet and the upper and lower edges of the opening so that rivet 33 is able to move vertically in opening 32 to a limited extent. Opening 32 is of a width substantially equal to the diameter of rivet 33, thereby precluding the rivet from moving transversely within the opening.

A resilient, spring-like can guide 34 is secured to project forwardly from lever 30 for engagement against the top of an inserted can. Can guide 34 includes a rearwardly projecting portion which extends through a rectangular opening 35 in lever 30. A rivet 36 secures the resilient can guide to the hand lever.

An irregularly shaped projection 38 is formed to extend downwardly from lever 30 near the right or free end thereof. The lower edge of projection 38 is smoothly curved terminating in a tip 38*a* located on the left side of the projection. A notch 38*b* is formed in the side of the projection at a location adjacently above tip 38*a*. Notch 38*b* has straight edges that join at a right angle to provide a square corner area therewithin.

A square stud 40 which serves as a catch member projects forwardly from frame 10 at a location to engage projection 38 and the notch 38*b* thereof. Stud 40 has a flat underside 40*a* and a flat right side 40*b* which meet at a right angle to provide a square corner on the boss so that it may be matingly received within the corresponding square corner area of notch 38*b*. The orientation of stud 40 is such that sides 40*a* and 40*b* are inclined, as shown in the drawings.

The motor (not shown) of the can opener is activated by a normally open switch having a plunger 41 located at the top of frame 10. Plunger 41 is biased upwardly by a spring or any other suitable biasing means (not shown) to normally maintain the motor in its off condition. A flat flange 42 is turned rearwardly at a right angle from the upper edge of lever 30 to overlie the top of the can opener and plunger 41. Flange 42 is located to depress plunger 41 and activate the motor when lever 30 is swung clockwise (FIG. 1) into can shearing position. The biasing force of plunger 41 acts upwardly against flange 42 to ordinarily maintain lever 30 in the substantially horizontal rest position in the absence of a downward force applied to the lever.

In operation, lever 30 is grasped near its free end and swung upwardly or counterclockwise to the approximate position shown in broken lines in FIG. 2. This pivots the lever about rivet 31 for only a very short distance until rivet 33 is moved against the upper edge of opening 32, whereupon plate 15 begins to pivot counterclockwise with the lever about the axis of can guide 16. This action moves cutter wheel 25 away from feed wheel 12 sufficiently to permit a can to be inserted in the usual manner with the rim or flange of the can on top of feed wheel 12. Lever 30 is then swung downwardly or clockwise which moves rivet 33 against the lower edge of opening 32 and thereafter pivots plate 15 clockwise unitarily with the lever. Cutter wheel 25 is thus moved downwardly against the lid of the can, and further pivoting of lever 30 causes the cutter wheel to pierce the can lid. Resilient can guide 34 acts downwardly against the top of the can to cooperate with fixed can guide 16 in maintaining the can rim firmly on top of feed wheel 12 for proper feeding traction of the can. The downward pivoting of lever 30 causes its flange 42 to depress plunger 41 which energizes the motor and thereby feeds the can relative to cutter wheel 25 as a result of the rotation of feed wheel 12. However, further downward movement of lever 30 is precluded by engagement of its underedge against the upper corner of stud 40.

After the lid of the can has been pierced, the curved edge of projection 38 adjacently below tip 38*a* comes into engagement with the inclined side 40*b* of stud 40. As the projection rides downwardly along side 40*b*, lever 30 is cammed to the right as viewed in FIG. 1. At the same time, resistance of the can lid to shear by cutter wheel 25 urges cutter mounting plate 15 to rotate counterclockwise about the axis of can guide 16 with this force tending to move lever 30 to the left. Accordingly, when tip 38*a* has cleared side 40*b*, the resistance force of the can to shear pulls lever 30 to the left and engages the square area of notch 38*b* against the square corner of stud 40, as shown in solid lines in FIG. 2. The user may then release lever 30 since the engagement of stud 40 with notch 38*b* retains the lever in place against plunger 41 as the can lid is sheared and the motor remains energized.

After the lid has been completely sheared from the can, the operating thrust force which previously urged plate 15 to pivot counterclockwise is no longer present. Therefore, the upward forces exerted on lever 30 by the resilient can guide 34 and plunger 41 move lever 30 upwardly and release notch 38*b* from stud 40. Plunger 41 is thus released from its depressed position, and the motor is automatically deenergized when the can lid has been completely sheared. The force of can guide 34 on lever 30 is sufficient to move the lever upwardly only to the position wherein its flange 42 rests on top of the fully extended plunger 41 as shown in FIG. 1. Accordingly, lever 30 is not moved upwardly far enough to release the can, which continues to be held in the can opener between feed wheel 12 and cutter wheel 25.

It is noted that lever 30 has only very limited pivotal movement relative to a cutter mounting plate 15 so that the pivoting of the lever effects substantially equal pivoting of the cutter mounting plate. However, the limited vertical movement permitted rivet 33 in elliptical opening 32 provides sufficient play to enable lever 30 to move left and right as required as notch 38*b* is engaged and released from stud 40. The preferred inclination of underside 40*a* of stud 40 is an angle midway between the angle nearest horizontal that still permits the automatic shut off to occur and the angle most inclined from horizontal that still retains notch 30*b* against releasing from stud 40 while the can lid is being sheared.

Referring now to FIG. 4, a second embodiment disclosing an alternative arrangement of the hand lever projection and the stud which engages same is shown therein. The majority of the can opener is constructed as previously described excepting the construction and shape of the hand lever projection and the stud, which are respectively designated by numerals 138 and 140 in FIG. 4. Projection 138 is gradually curved on its lower portion with the curved portion thence joining a straight edge 138*a* extending upwardly at an inclined angle on the left edge of the projection. Edge 138*a* terminates in a tip 138*b*, above which a notch 138*c* is formed in the projection. The inward portion of the lever forming notch 138*c* is smoothly rounded.

Stud 140 is in the shape of a pentagon, having a straight right side 140*a* extending at an inclined attitude with respect to vertical. A shorter side 140*b* extends upwardly and to the left from the top of side 140*a* while another short side 140*c* extends to the left from the top of side 140*b* in a substantially horizontal direction.

In operation, the second embodiment is used to shear a can lid in the same manner as previously described in connection with the first embodiment. After the can has been inserted and lever 30 has been swung downwardly to cause cutter wheel 25 to pierce the can lid, edge 138*a* comes into contact with side 140*b* of stud 140. As edge 138*a* rides downwardly along the inclined side 140*b*, the resultant camming action pulls lever 30 to the right. Again, however, the resistance of the end of the can to shear by cutter wheel 25 urges plate 15 to rotate counterclockwise, and this in turn urges lever 30 to the left. Consequently, when tip 138*b* clears side 140*b* and comes into contact with the top of side 140*a*, the resistance force of the can to shear pulls lever 30 to the left such that the edge of notch 138*c* is engaged against side 140*a* in the position shown in FIG. 4. Further downward movement of lever 30 is prevented because of the engagement of its underedge with side 140*c* of the stud. Lever 30 is thus held firmly in place with flange 42 maintaining plunger 41 in its depressed position during shearing of the can lid by cutter wheel 25.

After the can lid has been completely severed, the operating thrust which previously urged lever 30 to the left is no longer present, and the upward forces exerted by can guide 34 and plunger 41 move the lever upwardly to disengage projection 138 from stud 140. Plunger 41 is therefore released from its depressed position and the motor is automatically deenergized upon the completion of the shearing of the can lid.

Turning now to FIG. 5, a third embodiment of the invention is provided with still another alternative arrangement of the hand lever projection and stud. The can opener of the third embodiment is constructed substantially as previously described in connection with the first embodiment, the only modifications being in the shape of the hand lever projection 238 and the stud 240, along with the addition of a leaf spring 44 to the top of frame 10 and a hairpin type braking spring 45 to lever 30. In this embodiment, projection 238 has a smoothly rounded edge 238*a* which extends along the bottom of the projection and curves inwardly on the left side thereof. A smoothly curved notch 238*b* is formed in the left side of projection 238 adjacently above edge 238*a*. Stud 240 is of cylindrical configuration with a round exterior surface.

The leaf spring 44 is arch shaped and is provided with a flat end 44*a* which is riveted at 46 to the top of frame 10. Spring 44 is located such that flange 42 of the hand lever comes into engagement therewith to compress the spring when lever 30 is moved to the position shown in FIG. 5. Although the leaf spring 44 is illustrated only in the third embodiment, it is to be understood that it may also be used in the first two embodiments since it facilitates the automatic shut off feature of the invention, as will become clear.

The hairpin brake spring 45 is secured to the rearward surface of lever 30 by rivet 47 which extends through the round upper head portion of spring 45. Spring 45 includes opposite prongs 48 and 49 which extend generally downwardly from the head portion of the spring. Prongs 48 and 49 are substantially parallel to one another and are spaced apart a distance somewhat greater than the diameter of stud 240. An extrusion 50 projects from the rear surface of lever 30 at a location between prongs 48 and 49 in order to engage the prongs to prevent rotation of spring 45 on rivet 47 in either direction. Prongs 48 and 49 terminate in respective lower end portions 51 and 52 which are spaced apart and which curve inwardly toward one another, in convex fashion. At their closest point, the curved end portions 51 and 52 are spaced apart more closely than the diameter of stud 240. End portions 51 and 52 may be spread sufficiently to pass the stud, although their spring construction tends to return them toward one another.

In operation, a can lid is sheared in the third embodiment in the same manner as previously described. After a can has been inserted and lever 30 has been swung downwardly to pierce the can lid with cutter wheel 25, the rounded edge 238*a* comes into camming contact with the round surface of stud 240, and lever 30 is pulled to the right as a result of the camming action. At the same time, the resistance of the end of the can to shear by cutter wheel 25 urges plate 15 to pivot counterclockwise, which tends to move lever 30 to the left. Accordingly, notch 238*b* eventually becomes engaged around stud 240 in the position shown in FIG. 5. In this position, spring 44 is compressed due to its contact with flange 42. Further downward movement of the lever is prevented by engagement of its underedge with the top of stud 240. Lever 30 may then be released since it will be retained in place to keep plunger 41 depressed as the can lid is being sheared. Swinging of lever 30 downwardly also passes the end portions 51 and 52 of spring 45 below stud 240 on opposite sides thereof, as shown in FIG. 5.

When the end has been completely sheared from the can and the operating thrust force no longer urges lever 30 to the left, the force of can guide 34 and plunger 41, together with the force exerted by the compressed leaf spring 44, moves lever 30 upwardly to disengage projection 238 from stud 240. In this manner, plunger 41 is released from its depressed position and the can opener motor is deenergized automatically upon the completion of the shearing of the can end by cutter wheel 25. When lever 30 is in its normal rest position, leaf spring 44 maintains flange 42 above plunger 41 to assure that the motor will not be energized unless a downward force is exerted on the free end of the lever.

When it is desired to release the can, manual lifting of the free end of lever 30 causes the curved end portions 51 and 52 of spring 45 to cam against stud 240, which separates the end portions sufficiently to permit them to pass above the stud. Of course, when lever 30 is again lowered to an approximately horizontal position, portions 51 and 52 again cam against 240 to permit them to pass below the stud.

It is apparent that the provision of spring 45 permits the use of a leaf spring 44 of increased strength which assures that the automatic shutoff of the motor takes place as intended without the can being inadvertently released from the can opener. It is contemplated that a braking means such as spring 45 may be used in any of the disclosed embodiments of the invention, although it is to be understood that no braking means is required unless the forces that act to raise lever 30 during automatic shutoff are great enough to raise the lever a distance sufficient to release the can.

As an alternative to spring 45 as a brake for restraining the upward movement of hand lever 30, it is contemplated that leaf spring 44 may be magnetized and that at least the portion of the hand lever flange 42 in the vicinity of spring 44 may be constructed of iron or steel for attraction to the magnetized leaf spring. In this case, after spring 44 moves lever 30 upwardly upon completion of the can shearing, flange 42 remains magnetically attracted to spring 44. Lever 30 is thus raised only sufficiently to fully release plunger 41, and automatic shutoff of the motor is achieved without the can being released from engagement between feed wheel 12 and cutter wheel 25. When it is desired to release the can, lever 30 can be manually raised to overcome the magnetic attraction between flange 42 and spring 44.

From the foregoing, it will be seen that this invention is one well adapted to attain all of the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawing is to be interpreted as illustrative and not in a limiting sense.

Having thus described my invention, I claim:

1. In a can opener having an upright frame, a feed wheel supported for rotation on said frame, and power means for rotating said feed wheel, the combination therewith of:

a plate mounted for pivotal movement on said frame;

a cutting element for shearing a can, said cutting element being mounted on said plate for movement therewith into and out of can shearing position;

a hand lever coupled to said plate to effect pivotal movement thereof, said hand lever and plate being coupled for limited movement relative to one another;

a switch mechanism associated with said power means to energize and deenergize same, said switch mechanism being engageable by said hand lever to energize said power means;

a catch member on said frame operable to engagingly retain said hand lever against said switch mechanism during shearing of a can by said cutting element, said plate and said hand lever cooperatingly linked for movement on said frame to automatically release said hand lever from said catch member upon completion of the shearing of the can by said cutting element, said hand lever thereby releasing from said switch mechanism to effect deenergization of said power means.

2. The combination of claim 1, wherein said hand lever and plate are coupled for limited pivotal movement relative to one another to permit said hand lever to engage said catch member and disengage therefrom.

3. The combination of claim 1, wherein said can opener includes a spring member acting on said hand lever to urge same away from said catch member.

4. The combination of claim 1 wherein said can opener includes a camming surface on said catch member for camming contact against said hand lever to position same in engagement with said catch member.

5. The combination of claim 1, wherein said hand lever has a notch defined therein at a location to register with said catch member, said catch member being positionable within said notch to assist in retaining the lever against said switch mechanism.

6. The combination of claim 5, including a camming surface on said catch member for engagement with said hand lever, said camming surface operable to assist in registering said notch with said catch member by camming action.

7. The combination of claim 1, including releasable braking means for restraining the movement of said hand lever upon the release thereof from said catch member to retain a can between said feed wheel and cutting element.

8. The combination of claim 7, wherein said braking means includes a brake member on said hand lever engageable with said catch member to releasably restrain the movement of said hand lever away from said catch member.

9. The combination of claim 8, wherein said brake member includes yieldable spring portions for engaging said catch member.

10. The combination of claim 7, wherein said braking means includes magnetic means associated with said hand lever for magnetically restraining the movement thereof.

* * * * *